United States Patent [19]

Knoos

[11] 4,455,826

[45] Jun. 26, 1984

[54] THERMODYNAMIC MACHINE AND METHOD

[75] Inventor: Stellan Knoos, La Jolla, Calif.

[73] Assignee: AGA Aktiebolag, Lidingo, Sweden; a part interest

[21] Appl. No.: 406,257

[22] Filed: Aug. 9, 1982

[51] Int. Cl.[3] ..... F02G 1/00

[52] U.S. Cl. ..... 60/526; 60/517; 60/641.15; 62/6

[58] Field of Search ..... 60/517, 524, 525, 526; 62/641.15, 6

[56] References Cited

U.S. PATENT DOCUMENTS

| | | | |
|---|---|---|---|
| 3,115,014 | 12/1963 | Hogan | 60/526 X |
| 3,698,182 | 10/1972 | Knoos | 60/526 X |
| 4,389,844 | 6/1983 | Ackermann et al. | 60/525 X |

*Primary Examiner*—Allen M. Ostrager
*Assistant Examiner*—Stephen F. Husar
*Attorney, Agent, or Firm*—Fraser and Bogucki

[57] ABSTRACT

In thermodynamic apparatus and methods utilizing constant volume cycling devices, substantial improvements in energy output can be gained by utilization of an integrated thermodynamic process placing regenerator efficiency in a higher regime. Displacer elements operating in phased relation to the thermodynamic cycle provide superheating and supercooling to extended opposite ends of the regenerator, to establish steady state conditions which increase the temperature ratio of the system. In turn, the pressure ratio of the thermodynamic cycle is increased and the specific energy output improved. This expansion of the capability of thermodynamic machines for working in moderate temperature ranges is further utilized with systems for achieving thermal gain for heating or cooling, utilizing ambient energy as a heat source as well. It thus becomes feasible to effect thermal transformation between different temperature levels with high coefficients of performance, vastly increasing the number of alternatives available for practical thermal exchange systems.

50 Claims, 13 Drawing Figures

FIG. 1
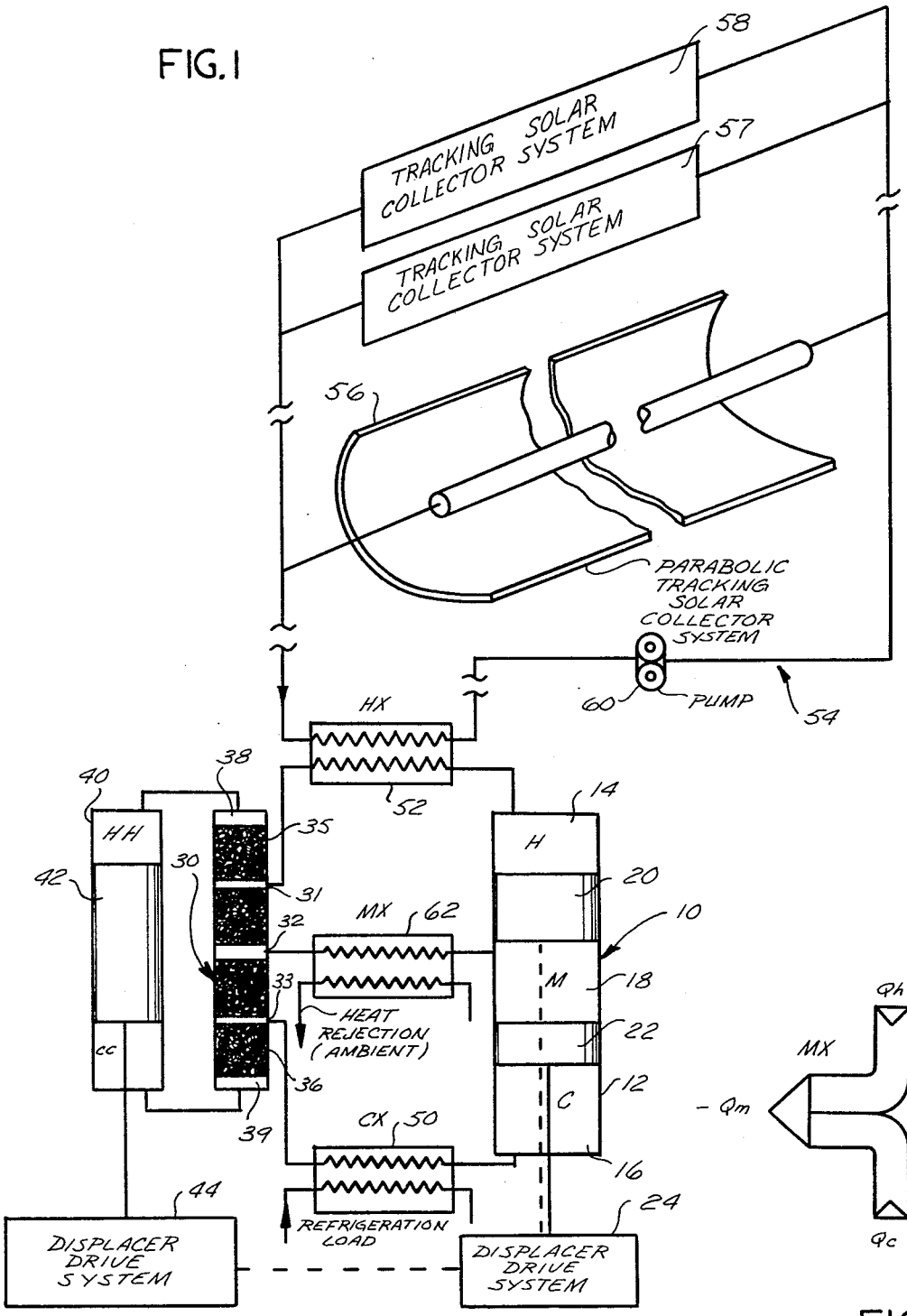
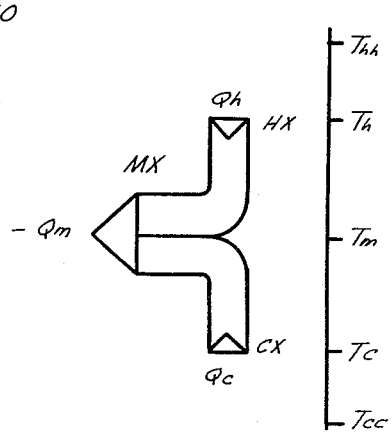
FIG. 6

FIG.12
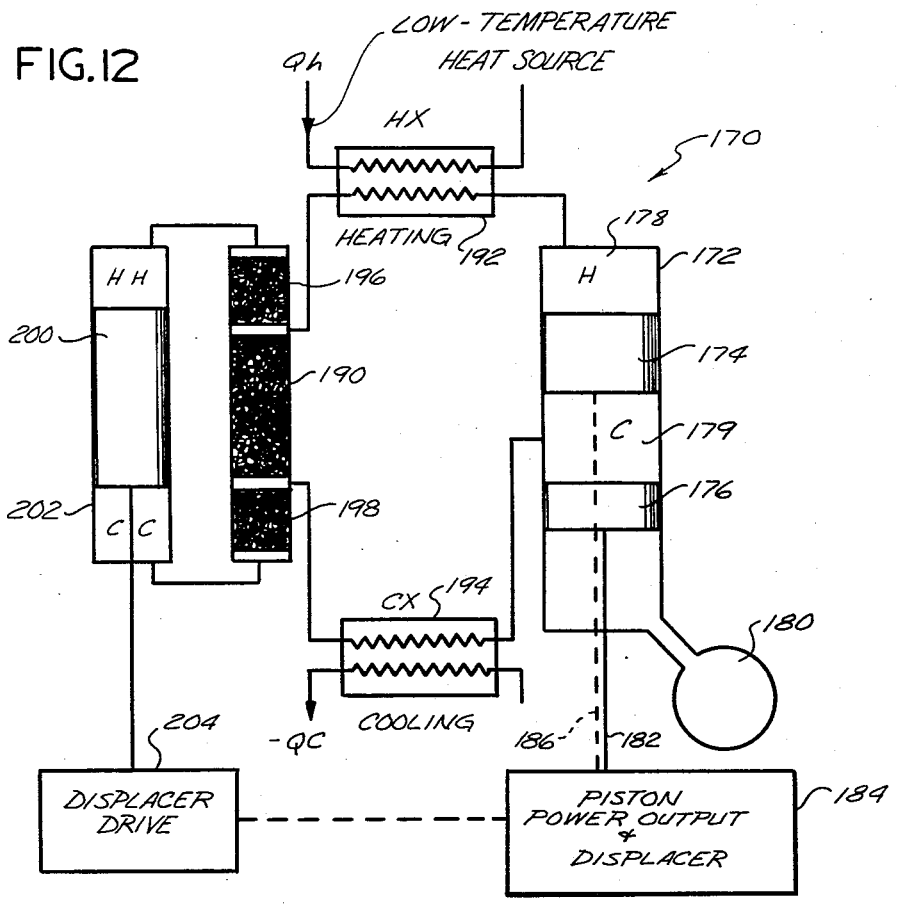
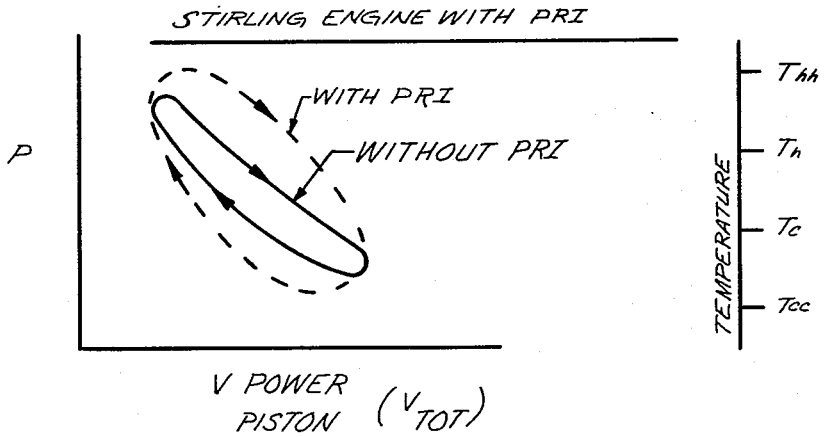
FIG.13

THERMODYNAMIC MACHINE AND METHOD

BACKGROUND OF THE INVENTION

In the use of thermal energy to generate power and induce temperature changes, the costs of fuel sources and the generally recognized need for conservation of energy inevitably dictate that there be increased usage of thermodynamic machines. A number of different types of these machines are known, such as Stirling cycle machines used for power and refrigeration, and Vuilleumier cycle machines used for inducing hot or cold temperatures. A different thermodynamic cycle is disclosed by the present inventor in U.S. Pat. No. 3,698,182, issued Oct. 17, 1972 for "Method And Device For Hot Gas Engine Or Gas Refrigeration Machine". A more recent development is described and claimed in a presently copending application for patent of the present inventor, entitled "Unitary Heat Engine/-Heat Pump System", filed Dec. 30, 1981, Ser. No. 335,659. Systems in accordance with this invention are capable of achieving substantial improvements in energy gain and coefficient of performance (COP) in deriving thermal outputs at intermediate temperature levels.

Thermodynamic machines can be constructed to operate with good thermal efficiency, and are capable of use for heating or cooling applications, or both. They are particularly attractive for energy conservation application, as described above in conjunction with the referenced patent application, because of their versatility and adaptability. They provide new opportunities for the potential use of solar energy, waste heat, and the heat content of ambient air, water and ground sources.

A distinction should be observed, however, between machines which induce thermal energy changes by using approximately constant volume thermodynamic cycles and those machines in which substantial pressure differentials exist and work is done by a power piston against an external medium. The essentially constant volume devices are exemplified by Vuilleumier devices, which are machines for inducing temperatures, and by the systems and methods disclosed in the previously referenced patent application. The latter may be characterized as heat pumps for energy gain. In contrast, the Stirling cycle machines create significant pressure differentials across a power piston and significant change in the internal volume (per work cell in a multicylinder system) and may be distinguished as heat engines.

Constant volume devices are particularly interesting for new applications, because of their versatility and reliability. Because they do not create substantial pressure differentials, they do not present the sealing problems and mechanical load problems that arise with Stirling cycle machines, and they can be very large, as well as reliable and maintenance free over long periods. Because they employ approximately constant volume displacement, they are particularly dependent upon the temperature ratio, the internal void (dead) volume, and the effectiveness of the regenerator in the system. The temperature ratio between the hot and cold ends of the regenerator, based upon absolute temperatures, is primarily determinative of system performance, particularly in terms of specific output. At low temperature ratios (e.g. substantially less than 2 to 1) the heat density for a given design and dead volume is usually unacceptably low. However, significant amounts of thermal energy may be available from intermediate level sources at below about 300° C. If one is to realize the benefits of these constant volume systems in using the heat content from solar, ambient and waste heat sources, therefore, it becomes extremely important to confront the problem of the temperature ratio limitation. The Knoos system described in the referenced patent application, for example, shows a number of noteworthy applications of a thermodynamic system in which the coefficient of performance can be substantially improved over prior art systems with comparable inputs. The description also demonstrates, however, that the system is dependent, in terms of specific energy (heat) output, on pressure and temperature ratios. Heretofore it has not been feasible to use thermodynamic machines of the constant volume type where temperature ratios are low. The temperatures of the heat sources are established by conditions of availability and are effectively immutable; the pressure ratio that then results may be so low that the machine operates with very low efficiency and specific energy (heat) output.

SUMMARY OF THE INVENTION

Thermodynamic machines and methods in accordance with the invention significantly improve the specific energy output derivable with given, relatively low, temperature ratios by pressure ratio intensification in resonance with the operative cycle of the machine and thermal energy interchange with associated superheated and supercooled regenerator chambers. By added compression and expansion at the hot and cold ends of the machine in selected phase relation to the principal displacer elements, and by series coupling of the superheated and supercooled regenerator chambers to the regenerator, the overall temperature ratio and thus also the pressure ratio are effectively increased to different steady state levels. The specific energy output and the coefficient of performance of the machine as a whole are materially greater because the machine is placed in a more efficient operating regime.

Thermodynamic machines in which concepts of the invention may be employed are preferably, but not necessarily, of the closed gas type having approximately constant internal volume. Such machines may be variously configured to induce temperatures or to function as heat pumps for energy gain, at high, medium or low temperature levels. The nature of the thermodynamic cycle renders them dependent upon temperature conditions and the effectiveness of the regenerator. The ability to better the specific energy output, in accordance with the invention, in response to thermal inputs having low temperature differential, greatly expands the applications and uses for these systems. The moderate temperature levels that are derivable from solar energy, waste heat and other common sources may now be efficiently used in these long-life reliable systems, which can be extremely large if desired. Temperature ratios (in degrees Kelvin) of substantially less than about 1.7 and temperature levels between −20° C. (253° K) and 300° C. (573° K) provide the principal practical ranges of interest for heat pumping. Furthermore, improved coefficient of performance can be derived in different senses and with different temperature level outputs from heat pump systems. It is consequently shown that a class of thermal transformers is provided for stepping up or stepping down temperature levels with excellent coefficients of performance and practically useful specific outputs.

In one specific example of systems and methods in accordance with the invention, a constant volume thermodynamic machine has hot, cold and intermediate level working chambers with hot and cold displacers cycling working fluid through a thermal regenerator coupled to all three chambers. A compressor-expander system including oppositely moving displacers, within superheating and supercooling regenerator chambers respectively, is driven in phased relation to the principal displacers. Cyclic net compression work of hot working fluid in the superheating chamber provides temperature pumping of the hot end of the regenerator addition, which is in direct series with the hot end of the regenerator. Concurrently at the cold end of the regenerator the cyclic net work of expansion in the supercooling chamber provides a supercooled temperature for that regenerator portion, and the process experiences a larger than normal temperature ratio. These factors translate over a full cycle into a greater pressure-volume area on the indicator diagram for the machine, and hence a greater specific energy output. By selection of the phase angle between each hot or cold displacer and its associated pressure ratio intensifying displacer, and by choice of the efficiency of the associated superheating or supercooling regenerator section, losses present in the regenerator additions are compensated and suitable steady state superheating and supercooling levels are achieved.

Among the features of the invention are the fact that thermal outputs can be derived, with significant energy gain (heat pump coefficient of performance), at the intermediate level while providing thermal inputs at the hot and cold levels which are not widely different. Moreover, an inverse function may be exercised, with thermal input being provided at the intermediate level and heating or cooling outputs being derived from the hot and cold levels respectively. When used as a thermal transformer, such a system can receive thermal energy transmitted from a source at one temperature level (e.g. superheated water or steam) and convert it, with a certain coefficient of performance (primarily dictated by the laws of thermodynamics and maximized to Carnot-process values) from an ambient sink to a different level.

Systems in accordance with the invention may be mechanized in a number of ways, which may be varied with the application. Thus the compressor/expander arrangement may be a single, double ended piston within a single cylinder, or provided by a pair of separate pistons which may in fact be in line with the basic displacers of the thermodynamic machine. Alternatively, the added regenerator and displacer functions over the basic device may be provided by a single, multi-section, reciprocating displacer-regenerator structure. The principles of the invention may also be used with benefit in heat engine systems, such as Stirling machines in which substantial piston pressure differentials are created during cycling. With superheating and supercooling of the hot working fluid and cold working fluid respectively, a higher power density can be achieved and also the regenerator inefficiency possibly reduced.

BRIEF DESCRIPTION OF THE DRAWINGS

The invention may be better understood by reference to the following description, taken in conjunction with the accompanying drawings, in which:

FIG. 1 is a combined schematic and perspective view, partially broken away, of a system in accordance with the invention employing pressure ratio intensification;

FIG. 6 is an energy diagram showing the qualitative character of thermal energy flows in the system of FIG. 1;

FIG. 12 is a schematic representation of yet another system using pressure ratio intensification in accordance with the invention; and FIG. 13 is an indicator diagram showing pressure vs. volume relationships in the system of FIG. 12 in contrast to conventional conditions.

DETAILED DESCRIPTION OF THE INVENTION

Figure 2:
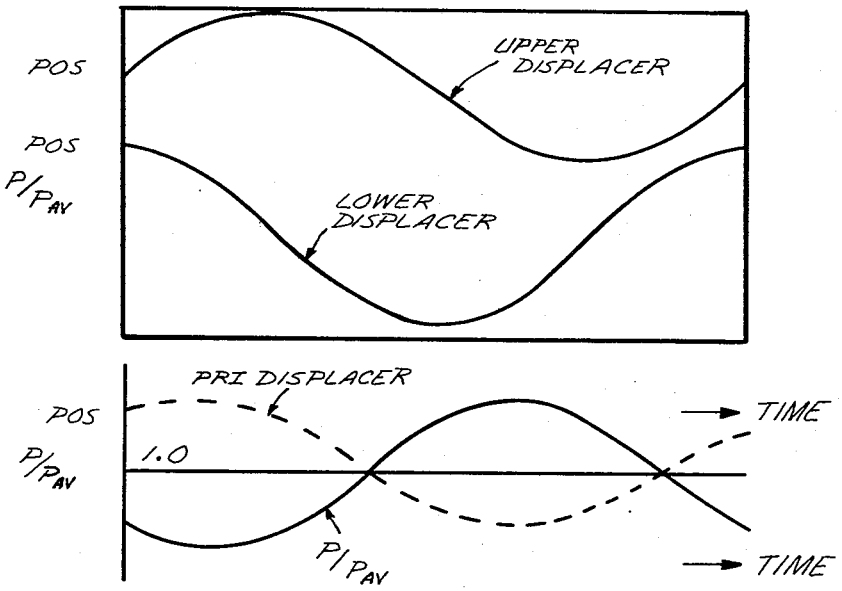
FIG. 2 is a diagrammatic representation of pressure variations in the various working chambers in the system of FIG. 1.

An improved constant volume thermodynamic machine is depicted in general and schematic fashion in FIG. 1, to which reference is now made. It is a solar-driven refrigeration system/heat pump. As described in the above referenced Knoos application, Ser. No. 335,659, an integral heat engine/heat pump 10 is depicted in simplified form in this example and includes a housing 12 within which a hot working chamber 14, a cold working chamber 16 and an intermediate temperature level working chamber 18 are disposed. A hot displacer 20 and a cold displacer 22 are reciprocated within the cylindrical housing 12 by a displacer driver system 24; and in phased relationship to each other as described hereafter.

Shunting the working chambers and forming a part of the thermodynamic machine 10 is a regenerator 30 which has a hot temperature level 31, an intermediate temperature level 32 and a cold temperature level 33 between which the heat retaining mesh, particulate or fibers of the regenerator are disposed in conventional fashion. In this regenerator 30, however, a superheating extension 35 and a supercooling extension 36 are coupled in serial fashion to the opposite ends and comprise interior regenerator sections that are in communication with the principal interior body of the regenerator 30. A superheated level 38 and a supercooled level 39 at each end of the regenerator 30 are coupled to the opposite ends (designated hh and cc respectively) of a compressor/expander chamber 40 within which a double ended displacer 42 is reciprocated by a displacer drive system 44. The displacer drive system 44 reciprocates the displacer 42 in a phased relation, described in greater detail hereafter, relative to the cyclic movement of the displacers 20, 22 in the cylindrical chamber 12.

The regenerator extensions 35, 36 are high efficiency units, and in accordance with regenerator designs for thermodynamic machines preferably have a thermal efficiency in excess of 99%. This can be achieved for example by stacking fine mesh screens having typical diameters in the range of 0.02 to 0.08 mm. The displacer drive systems 24, 44 are not required to consume a substantial amount of mechanical energy inasmuch as the displacers are not required to act against substantial gas pressure differences and at any point in time the gas pressure within the system is substantially equal, apart from pressure losses and friction losses in the various conduits.

The conduits interconnecting the cold, hot and intermediate level working chambers 14, 16 and 18 respectively to their corresponding temperature level openings 33, 32 and 31 respectively in the regenerator 30 are made through external heat exchangers. In the present example it is desired to provide thermal inputs to the thermodynamic machine 10 at the cold and hot ends, and to reject thermal energy at the intermediate level. Accordingly, the cold working chamber 12 and the cold temperature level 33 of the regenerator 30 are coupled to one side of a cold level (CX) heat exchanger 50 which has counter- and concurrent-flow or cross-flow passageways for receiving thermal energy from the refrigeration load, carried by air or a liquid, for example, typically in the range of −10° to +30° C. Between the hot temperature level 31 of the regenerator 30 and the hot working chamber 14, the intercoupling conduit is passed through a hot level (HX) heat exchanger 52, with the heat source flow being derived from a heating system 54. The heating system 54 comprises in this example a bank of parabolic tracking solar collector systems 56, 57, 58, and it will be understood that one or a substantial number may be utilized dependent upon the thermal capacity of the thermodynamic machine. Flow is established through the hot level heat exchanger 52 by a pump 60.

At the intermediate temperature level, heat is rejected, e.g. to ambient air, from an intermediate level heat exchanger 62 (designated MX), through the counterflowing or cross-flowing passageways of which a fluid flows to a utilization device (not shown). Temperatures at the hot level heat exchanger 52 are of a moderately elevated level, in the range of 230° to 290° C. in this example. Temperature level from the MX exchanger 62 is typically in the range of 40° to 60° C. Those skilled in the art will recognize that the temperature levels at the two thermal inputs are readily realizable and may be provided from a number of alternative sources in addition to those mentioned. For example, at the hot end of a machine, the thermal energy may be in the form of waste heat from an industrial process or heat rejected from a power plant.

In the operation of the system of FIG. 1, the operative considerations mentioned in the previously referenced patent application are generally applicable. They are, however, modified in accordance with the invention so that a significant refrigeration load in relation to the solar heat input can still be obtained even though the temperature ratio is less than approximately 1.7, taking the ratio of the values of the temperatures in the hot chamber 14 and cold chamber 16 stated in degrees Kelvin. Even a highly efficient regenerator becomes insufficiently effective when the temperature ratio is low and pressure ratio is approaching unity. The degree of regeneration effectiveness is crucial to the essentially constant-volume thermodynamic process particularly since the pressure-volume integral in the PV indicator diagram is generally small and determined solely by these thermodynamic considerations. In the system of FIG. 1, referring to FIG. 2 as well as to FIG. 1, the cycling of the hot "upper" displacer 20 is shown in phase relation to the cycling of the cold "lower" displacer 22, with the cold displacer leading in phase so as to provide pressure profiles as shown. For these pressure profiles, the pressure minimums exist when the displacers 20, 22 are near their top positions, and pressure maximums exist when the displacers 20, 22 are near their bottom positions. Further, the pressure is high when the volume of the hot chamber 14 increases, and the pressure is low when the volume of that chamber decreases. This allows for a cyclic net expansion of gas in the hot chamber and a heat load into the hot level heat (HX) exchanger 52 for steady state conditions to persist. Thus there is a positive thermal energy flow, $Q_h$, into the thermodynamic machine 10, using the convention that the thermal energy flow is positive when it flows into the machine.

The pressure profiles in the hot and cold working chambers 14, 16 do not quantify the pressure ratio because the base line is not represented. However, it will be recognized that the pressure ratio may typically be 1.1 or less with a temperature ratio of 1.7 or less, depending upon the ineffectiveness of the regenerator 30 and the amount of void space in the machine. In accordance with the invention, however, an integrally related thermodynamic process is utilized to achieve what may be called "pressure ratio intensification" (PRI). As shown in the lower diagram of FIG. 2, the double ended displacer 42 of FIG. 1 is reciprocated in synchronism and chosen phase relation with the hot and cold displacers 20, 22. The phase relationship chosen is one in which the double ended displacer 42 is near its top position when the pressure is minimum and the hot and cold displacers 20, 22 are near their top position, so that working fluid is pushed into the supercooled chamber, designated cc, adjacent the bottom end of the displacer 42. Conversely, the displacer 42 is near its bottom position when the system pressure is maximum, and the displacers 20, 22 are near their bottom position. At this time gas is pushed into the superheated chamber hh adjacent the top end of the displacer 42. By this arrangement, the chambers hh and cc are always varied in volume precisely 180° out of phase, and in resonance with the cycling of the remainder of the system. The extent and sense of the phase shift between the double ended displacer 42 and the hot and cold displacers 20, 22 is chosen to provide a P-V cycle in the hh and cc chambers that tends to heat the hh chamber above the hot chamber 14 level, and cool the cc chamber below the cold chamber 16 level. Thus the hh chamber may be said to be "superheated", and the cc chamber may be said to be "supercooled" with the result that the temperature ratio across the length of the regenerator 30, including the superheated and supercooled ends 38, 39 and the extensions 35 and 36 is increased. The net superheating and supercooling effect at each end, however, is only sufficient to overcome thermal energy losses in the regenerator extensions 35, 36 so that steady state conditions are achieved at each end of the regenerator 30. With the temperature ratio at the regenerator 30 thus increased, the ineffectiveness of the regenerator is of less importance, and the apparent pressure ratio at the thermodynamic machine 10 is effectively increased. For example, the constant-volume machine with a pressure ratio of 1.1 to 1 may be increased to the range of between 1.2 and 1.3 to 1.

It should be noted that the thermal efficiency of the regenerator extensions 35, 36 as well as the phase shift angle between the double ended displacer 42 and the hot and cold displacers 20, 22 are considered together in determining the superheated and supercooled temperature levels hh and cc established in the steady state.

Figure 3:
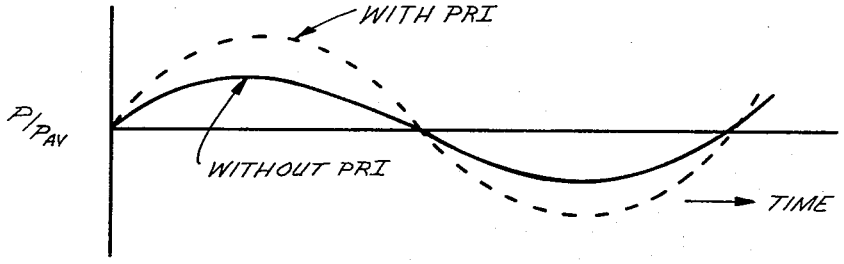
FIG. 3 is a diagrammatic representation of pressure cycle variations in the system of FIG. 1 depicting the difference between conventional operation and operation using pressure ratio intensification.
Figure 4:
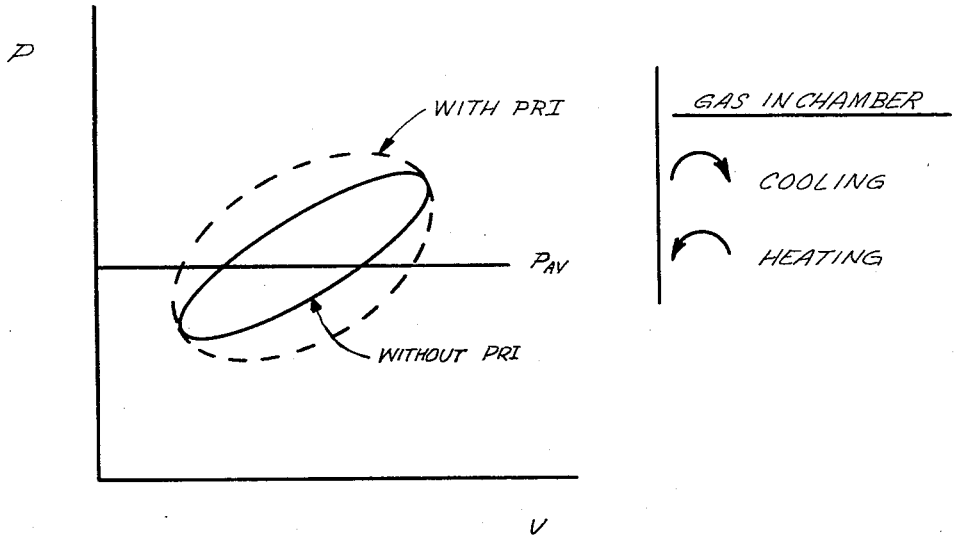
FIG. 4 is a diagrammatic representation of variations in pressure vs. volume for both conventional operation and operation using pressure ratio intensification.

A comparative depiction of the effect of pressure ratio intensification on working fluid pressure in a constant-volume machine is shown in FIG. 3, in that the pressure swings with PRI are substantially greater than those of the conventional machine. This carries over, as seen in FIG. 4, directly into an increase in power density of the machine, because the P-V indicator diagram is expanded with PRI to a greater included (integral) area per cycle. In effect, the very small amount of work input needed to reciprocate the displacer for superheating and supercooling is more than adequately compensated for by the improvement in thermal interchanges within the cycle.

Figure 5:
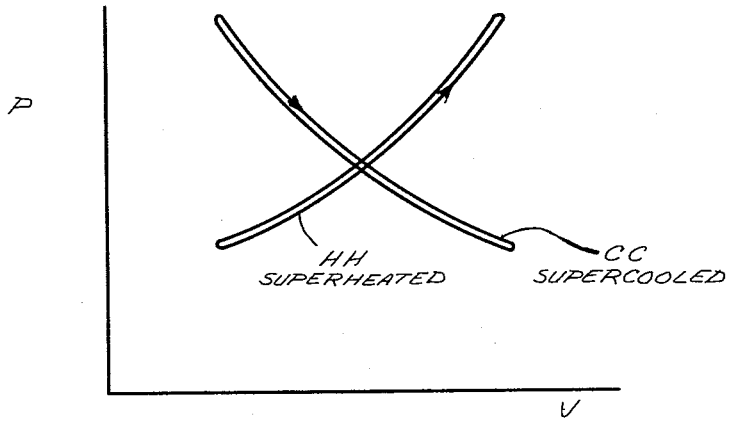
FIG. 5 is an indicator diagram of pressure vs. volume relationships existing in a portion of a pressure ratio intensification system.

The work input required to the added displacer to achieve superheating and supercooling is under the stated conditions typically substantially less than the heat loads with which the system cooperates. The double ended displacer 42 preserves the constant volume nature of the system and the phase angle variations are sufficiently small that the P-V indicator diagrams and the hh and cc chambers have small included (integral) areas, as shown in FIG. 5. The superheating cycle as shown by the counterclockwise curve in FIG. 5 (negative P-V integral value), and the supercooling cycle as shown by the clockwise curve in FIG. 5 (positive P-V integral value) are approximately anti-symmetrical in nature.

The quantitative and relative temperature levels of the various thermal energy exchanges may be depicted in general form as seen in FIG. 6. Heat energy flows into the machine at the hot temperature $T_h$ (into the hot level heat exchanger 52) and at the cold temperature $T_c$ (into the cold level heat exchanger 50). Heat energy is rejected to ambient at the intermediate level $T_m$, the exchange being designated $-Q_m$, because thermal energy flows out of the machine. It will be evident to those skilled in the art that the refrigeration level $T_c$ is generated with improved COP because of the use of ambient temperature levels in this heat pump system.

A number of significant advantages and applications are derived from these concepts. As is shown below, the constant-volume thermodynamic cycles may be utilized where temperature levels are highly useful to human habitations and processes, but involve temperature ratios that have heretofore rendered them uneconomic. Moreover, it now becomes practically feasible under certain conditions to shift the temperature level of a heated mass, with an associated thermal gain factor, (limited by Carnot-process values) in what may be termed a "thermal transformer".

Figure 7:
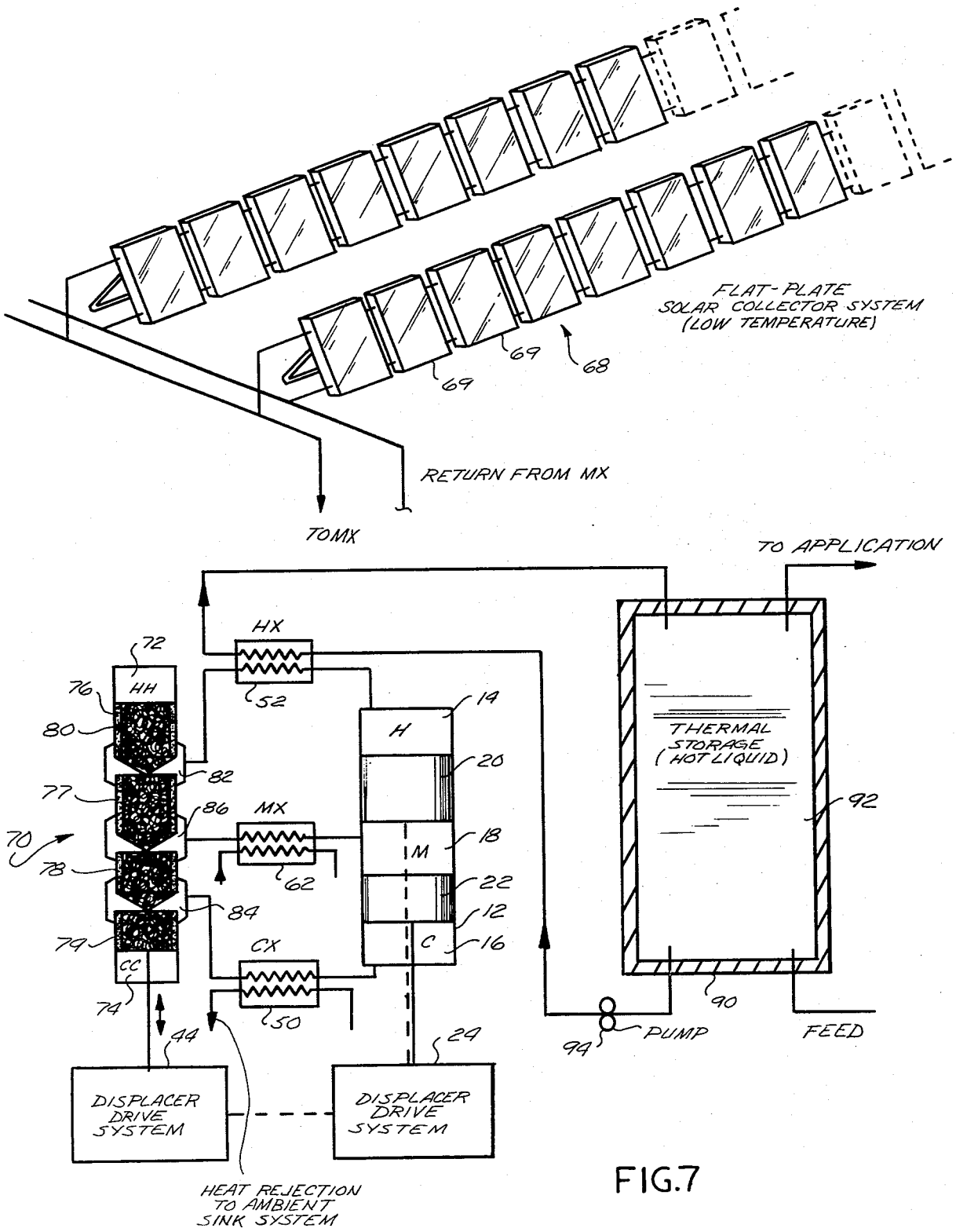
FIG. 7 is a combined schematic and perspective representation of a different system using pressure ratio intensification in accordance with the invention.

For example, referring now to FIG. 7, in which portions of the system corresponding to the arrangement of FIG. 1 are similarly numbered, a heat pump application is provided that is the inverse of the previously disclosed system. In FIG. 7, the thermal input is at a moderate temperature level such as in the range of 40° to 60° C., being derived from a bank 68 of flat plate solar collector panels 69. At this temperature level, the heat pump will not, without PRI, induce hot and cold temperature levels adequate to provide sufficient energy density to be of interest. With pressure ratio intensification, however, the head load levels become meaningful. For this purpose the thermodynamic machine includes a combined displacer and regenerator 70, in which a superheated chamber 72 at the upper end and a supercooled chamber 74 at the lower end are separated by a sequence of four regenerator sections 76, 77, 78 and 79, with the upper and lower regenerator sections 76 and 79 comprising the regenerator extensions. The side walls of the regenerator sections are bounded by thermal insulators 80. The intermediate sections 77 and 78 are bounded by an upper or hot temperature level chamber 82 and a lower or cold temperature level chamber 84 and jointly accessible to an intermediate level chamber 86, each of which is connected by conduits through the appropriate heat chamber to the corresponding section in the displacer system. Again, the reciprocating regenerator sections 76 to 79 cause displacement of the working fluid in phased relation to the movement of the displacers 20, 22, but the phase angle relationship is varied to account for the fact that thermal outputs are to be derived at the hot and cold ends.

At the hot end, the hot level heat exchanger 52 is in communication with an external thermal storage 90, which stores a hot liquid 92 as shown, but the heat exchanger 52 may alternatively be coupled to a two-phase system having a suitably high heat of fusion, or it may incorporate some other form of thermal storage. FIG. 7 shows a pump 94 providing circulation into the pure liquid thermal storage, from which hot liquid may be withdrawn for use in an intended application.

With this system, the hot level output is lifted to the range of approximately 95° C., and the heat rejected to the ambient sink system at the cold level heat exchanger 50 is in the range of −10° to +30° C. Accordingly, the heat pump functions in a fashion suitable for water heating at the hot level.

Figure 8:
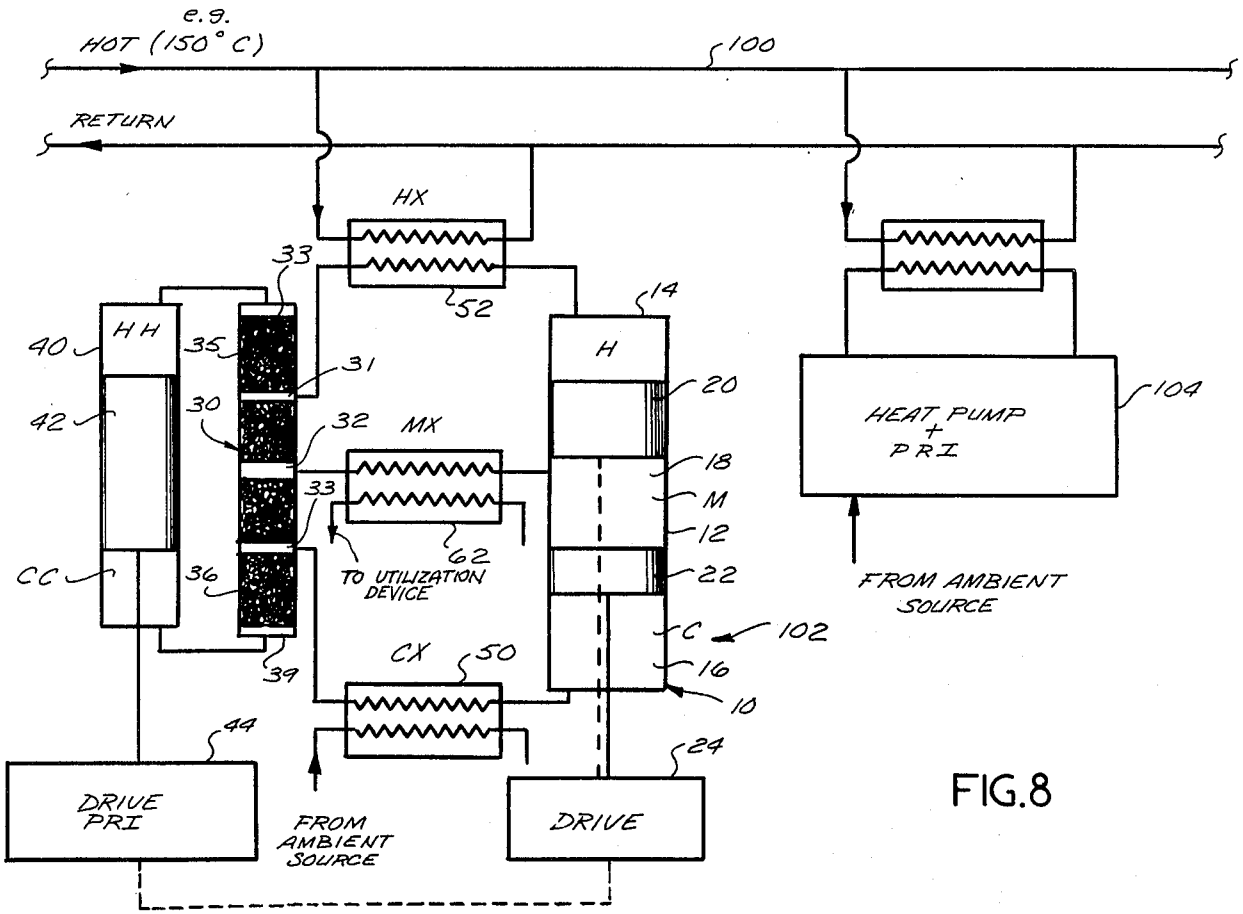
FIG. 8 is a schematic representation of yet another example of a system using pressure ratio intensification to provide thermal gain in transforming thermal energy from a central source to local use.

In the system shown in FIG. 7, the thermal transformer operation involves a temperature shift from $T_m$ up to $T_h$ with a thermal gain factor $-Q_h/Q_m$ less than unity. In the example of FIG. 8, to which reference is now made, the thermal transformer effect is utilized in conjunction with central heating with an energy gain factor $COP \equiv -Q_m/Q_h$ = coefficient of performance larger than one. Where a central source of heat, such as superheated water under a pressure of 150° C. is provided as high temperature input on a long length conduit 100, it is desired to provide output fluid at a lower temperature level useful for residential heating, with a coefficient of performance giving an energy gain substantially greater than 1.0. For each local installation, a different heat pump 102, 104 is employed that is coupled to the hot pressurized source line 100 and receives heat from an ambient source in the range of −10° to 15°. Each local installation therefore can extract energy with thermal gain (high COP) from the common line 100. With the usage of PRI, the energy density becomes desirably high, as well as the COP, despite the low temperature ratio and the relatively small temperature range that is involved.

Figure 9:
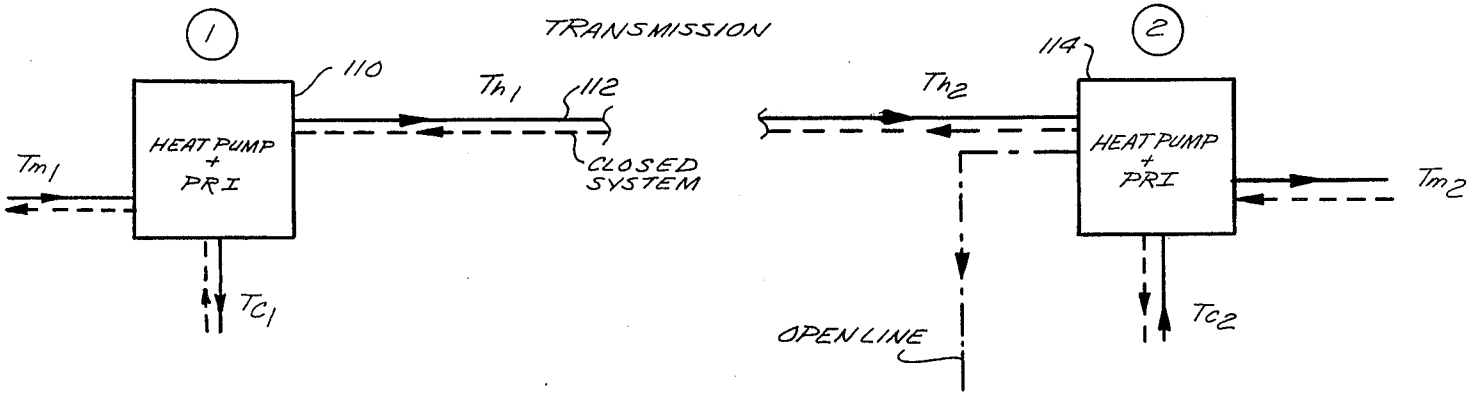
FIG. 9 is a diagrammatic representation of a thermal transformer application using systems in accordance with the invention.
Figure 10:
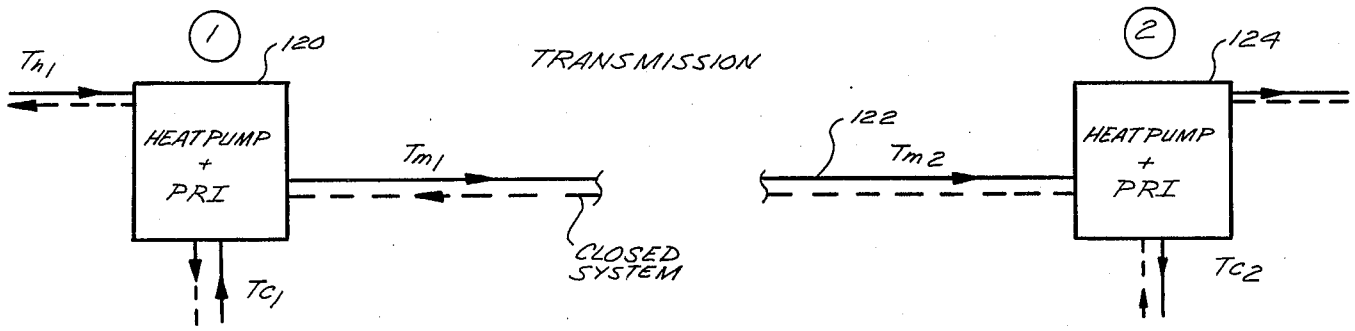
FIG. 10 is a diagrammatic representation of a second thermal transformer application using systems in accordance with the invention.

Using pairs of pressure ratio intensified heat pumps in complementary fashion, as shown in FIGS. 9 and 10, thermal energy may be shifted from one temperature level to another more suitable for purposes of long line transmission. In FIG. 9, thermal energy at an intermediate temperature level $Tm_1$ is transformed in the first heat pump with PRI 110 to an output at a higher temperature level $Th_1$ for transmission on a closed line 112 (the return line being shown in dotted lines) to a second heat pump (also with pressure ratio intensification) 114. At the second heat pump 114 the temperature of the incoming hot fluid is somewhat reduced to the level $Th_2$ because of thermal losses, but the output at level $Tm_2$ is derived with energy gain (COP>1.0). Thus, in the first heat pump 110 waste heat below 100° C. can be the input, with the high temperature exchanger being a boiler, and with forward transmission to the second heat pump 114 being of pressurized steam above 100° C. At the second heat pump 114 the high temperature exchanger condenses the steam during generation of the thermal output $Tm_2$. The transmission line between the heat pumps may also be an open line, without a return, in which event the overall efficiency is lower in principle and the fluid in the high temperature line can be dumped at the second heat pump, or utilized as a waste heat application, or alternatively combined with the $Tm_2$ output.

In the system of FIG. 10, a pair of heat pumps with pressure ratio intensification which may be regarded as thermal transformers 120, 124 are again intercoupled by a transmission line 122, with the return line being shown as dashed lines (although the system could again with less efficiency be open). In this instance the transmission line may be required to transport thermal energy from a distant power station which generates waste heat, e.g. superheated steam at 150° C. and elevated pressure. If the length of a direct transmission line for this temperature level makes it inordinately expensive for this application, the thermal transformer systems 120, 124 are utilized to step down from the input level $Th_1$ at the source, and then to step back up to the output level $Th_2$ for local use. The thermal energy can then be transmitted by liquid water below 100° C. and atmospheric pressure levels, so that less expensive piping and less thermal insulation is required,. Other two-phase systems, such as ammonia, may be used for still lower temperature levels, transmitted in gaseous form in the lines, and returned in liquid form.

Figure 11:
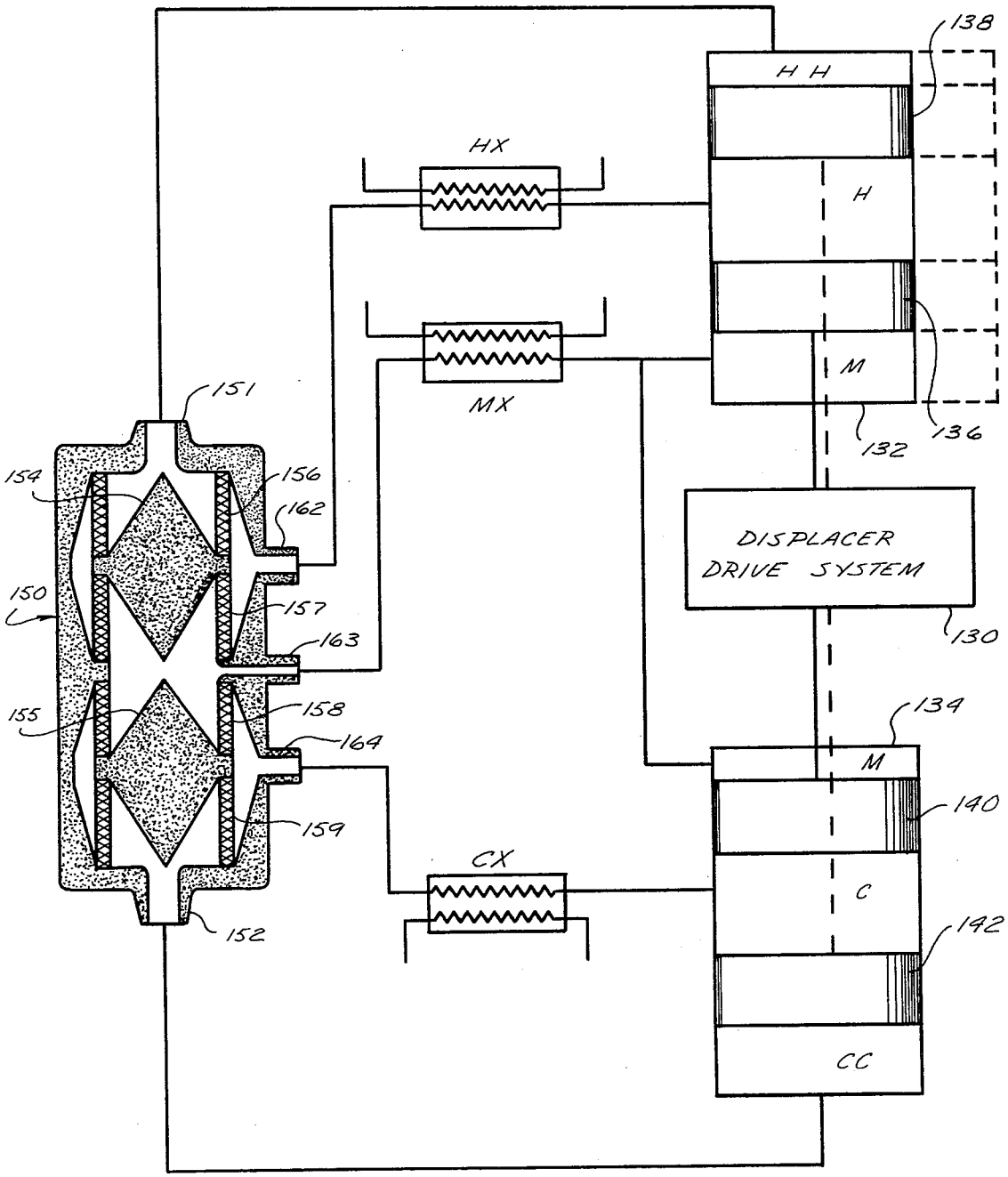
FIG. 11 is a combined schematic and sectional view of a different system using pressure ratio intensification in accordance with the invention.

Thermodynamic machines in accordance with the invention make possible the use of a number of different displacing and regenerative devices, one combination of which is shown in FIG. 11. Here the displacer drive system 130 operates to reciprocate displacers in first and second cylinders 132, 134 respectively. In the first cylinder 132, a hot displacer 136 and a PRI displacer 138 are coupled by separate drive mechanisms, indicated schematically, to the displacer drive system 130 and moved synchronously with a given phase relation between them as previously described. The cross-sectional area of the chamber 132 and the displacers 136 and 138 may be made substantially different to provide a differential relative to the other cylinder 134, as shown by the dashed line enlargement. In the second cylinder 134, the cold displacer 140 and the associated pressure ratio intensification displacer 142 are also moved in specific phase relationships to each other and to the hot displacer 136, with the displacer 142 associated with the cc chamber being substantially 180° out of phase with the opposite displacer 138 associated with the hh chamber. Superheating and supercooling in the regenerator extensions again take place, with consequent enhancement of the temperature ratio and improvement of the energy output density. The phase relationships may be selected in accordance with the direction of energy transfer.

Also in FIG. 11 there is depicted a radial-flow regenerator 150 having end input ports 151, 152 communicating with the hh and cc chambers respectively. The walls of the regenerator 150 may be of an insulating material (e.g. ceramic) as may interior core elements 154, 155 minimizing dead volume. Concentric with the central axis of the cylindrical regenerator 150, end regenerator rings 156, 159 constitute the regenerator extensions. The intermediate regenerator rings 157, 158 define the hot, intermediate and cold levels of the regenerator, to which separate ports 162, 163, 164 extending from the side wall of the regenerator body 150 are coupled. Only the intermediate port 163 is coupled to the interior of the volume, within the inner radius of the intermediate rings 157, 158.

With the arrangement of FIG. 11, not only may the relative cross-sectional areas of the cylinders 132, 134 be made to differ, but the stroke lengths may also be varied more readily if desired. It should be noted that while the instantaneous volume of the intermediate chamber is defined by the opposing faces of the two moving piston displacers 136, 140, the hot and cold working chambers are defined by two opposed moving faces as well, although this does not prevent the establishment of harmonic motion.

A Stirling engine system 170 in accordance with the invention is depicted in simplified form in FIG. 12 as an inline, single cylinder 172 device including a Stirling engine displacer 174 and power piston 176, the upper surfaces of which act against a hot chamber 178 and a cold chamber 179 respectively. A buffer chamber 180 communicates with the opposite side of the power piston 176 from the cold chamber 179. A connecting link mechanism 182 couples the power piston to a power output device 184 which also is coupled by a separate linkage 186 to drive the displacer 174 in phased relationship to the power piston. A regenerator 190 is coupled to one set of passages in a HX heat exchanger 192, the same passages also communicating with the hot chamber 178. Similarly, a CX heat exchanger 194 intercouples the cold temperature level section of the regenerator 190 to the cold chamber 179. A moderate temperature heat source providing thermal energy $Q_h$ input to the hot level temperature heat exchanger 192 provides thermal energy for the system while thermal output $-Q_c$ (heat rejection) is derived from the cold level temperature heat exchanger 194. A superheated regenerator extension 196 and a supercooled regenerator extension 198 are coupled in series to the intermediate portion of the regenerator 190, and communicate with the hh and cc chambers at the opposite ends of a PRI displacer 200 within a cylindrical chamber 202. A displacer drive 204 coupled to the displacer 200 reciprocates the displacer in a selected phase relationship to the power piston 176.

For brevity and simplicity, the Stirling engine that is depicted is less complicated than the double acting, four cylinder arrangements currently most often in use. With such arrangements, it will be recognized that each subsystem must have its own pressure ratio intensification mechanism, i.e. four PRI devices.

A Stirling engine operated with a low temperature heat source typically provides such low specific power output (kilowatt/engine displacement) that it cannot be productively used. By low temperature heat source is meant a source such as a 300° C. or lower temperature level generated from a concentrator type of solar collector bank. Although the Stirling engine does generate substantial compression ratio under these conditions, the indicator (P-V) diagrams are too thin and pressure ratio intensification can be of substantial benefit. As seen in FIG. 13, the P-V indicator diagram becomes wider, the power density increases, and because of the reduction in the inefficiency of the regenerator the overall efficiency of the engine could also be improved.

Although a number of forms and modifications in accordance with the invention have been described, it will be appreciated that a wide range of alternative systems and methods may be employed, and encompassed within the appended claims.

What is claimed is:

1. A thermodynamic machine for deriving thermal energy output with a useful coefficient of performance despite the existence of low temperature ratios in the working fluid for the machine, comprising:

a thermodynamic system including a regenerator and means for cyclically pumping working fluid between a hot end and a cold end of the regenerator;

means coupled to the hot and cold ends of the regenerator and in communication with the working fluid therein for providing superheated and supercooled chambers adjacent the hot and cold ends respectively;

first regenerator extension means communicating between the hot end of the regenerator and the superheated chamber; and second regenerator extension means communicating between the cold end of the regenerator and the supercooled chamber.

2. The invention as set forth in claim 1 above, wherein the means for providing superheated and supercooled chambers include displacer means cycling in phased relation to the cycling of the means for pumping working fluid.

3. The invention as set forth in claim 2 above, wherein the displacer means comprises a superheating and a supercooling displacer moving in opposed phase relation and the phase angle relative to the means for pumping working fluid is selected relative to the regenerator extension means to establish steady state superheated and supercooled temperature levels in communication with the regenerator, whereby the pressure ratio of the thermodynamic machine is intensified and energy output is increased.

4. The invention as set forth in claim 3 above, wherein the first and second regenerator extension means have thermal efficiencies in excess of 99%.

5. The invention as set forth in claim 4 above, wherein the thermodynamic machine is a constant volume system including at least first and second displacers and means for cycling the displacers.

6. The invention as set forth in claim 5 above, wherein the thermodynamic machine includes hot, intermediate level and cold working chambers.

7. The invention as set forth in claim 4 above, wherein the thermodynamic machine is a Stirling heat engine comprising at least one displacer and power piston means.

8. For use with a thermodynamic machine having a regenerator coupled between a hot chamber and a cold chamber of cyclically varying volume, the combination comprising a pair of thermal energy storage units, each coupled to a different end of the regenerator and in communication therewith, and means coupled to each of the different thermal storage units for establishing heating and cooling levels therein providing a greater difference than the difference between the hot and cold chambers.

9. The invention as set forth in claim 8 above, wherein the means for establishing heating and cooling levels comprises a pair of chamber means including volume varying means operating in resonance with the thermodynamic machine.

10. The invention as set forth in claim 9 above, wherein the volume varying means operates in opposite senses relative to each of the chambers, and in phased relation to cyclical volume variations of the hot and cold chambers.

11. The invention as set forth in claim 10 above, wherein the thermodynamic machine is a constant volume system.

12. A thermodynamic machine of the type including a hot chamber and a cold chamber and means operating cyclically in each of said chambers to transfer a working fluid therebetween through a regenerator, comprising the combination of:

first means including first displacer means coupled to the hot end of the regenerator and cycling in phased relation to the means operating cyclically in the hot chamber;

second means including second displacer means coupled to the cold end of the regenerator and cycling in phased relation to the means operating cyclically in the cold chamber; and each of said first and second means including means for establishing a steady state temperature level, the temperature level increasing the temperature ratio across said regenerator, whereby regenerator effectiveness is increased and the pressure ratio of the system is intensified.

13. The invention as set forth in claim 12 above, wherein said first and second means operating cyclically comprise reciprocating devices in the hot and cold chambers.

14. The invention as set forth in claim 13 above, including means responsive to the motion of the reciprocating devices for cycling the first and second displacer means in opposite phase.

15. The invention as set forth in claim 14 above, wherein said reciprocating devices and said first and second displacer means provide a substantially constant volume thermodynamic cycle, and wherein said first and second means each includes regenerator means coupled to communicate separately with the associated hot or cold end respectively of the regenerator.

16. The invention as set forth in claim 15 above, wherein the ratio of the temperature levels, in absolute temperature, at the hot and cold chambers is less than about 1.7 for given thermal conditions.

17. The invention as set forth in claim 16 above, wherein the regenerator means in said first and second means have thermal efficiency in excess of 99% and where the phase relationship of the first and second displacers relative to the reciprocating devices, and the characteristics of the regenerator means in the first and second means are selected to establish steady state temperature levels at the regenerator means such that one is superheated and the other is supercooled relative to the temperature levels of the hot chamber and cold chamber respectively.

18. The invention as set forth in claim 14 above, wherein the thermodynamic machine comprises two working cylinders, a first of which includes the hot working chamber and the second of which includes the cold working chamber, and wherein the first displacer means is disposed in the working cylinder including the hot working chamber and the second displacer means is disposed in the working cylinder including the cold working chamber.

19. The invention as set forth in claim 18 above, including in addition drive means coupled to the reciprocating means in the hot and cold working chambers and the first and second displacer means for cycling such means in phased relationship.

20. The invention as set forth in claim 19 above, wherein the first working cylinder defines a superheated working chamber in communication with the first displacer means and wherein the second working cylinder defines a supercooled working chamber in communication with the second displacer means, and including in addition first regenerator means coupling the superheated working chamber to the hot working chamber through a portion of the regenerator for the thermodynamic machine, and second regenerator means coupling the supercooled working chamber to the cold working chamber through a different portion of the regenerator for the thermodynamic machine.

21. The invention as set forth in claim 20 above, wherein the regenerator for the thermodynamic machine and the first and second regenerator means comprise an insulating hollow body along a selected axis, a series of circumferential regenerator sections disposed along the axis within the body, interior divider means between the regenerator sections for directing working fluid flows radially inwardly or outwardly through the different regenerator sections, and port means coupled to the body at different regions therealong for communicating working fluid with the thermodynamic machine.

22. The invention as set forth in claim 14 above, wherein the regenerator for the thermodynamic machine, the first means and the second means comprise a regenerator enclosure extending along an axis and a series of interconnected regenerator sections within the enclosure and reciprocable along the axis, and means responsive to the cyclical operation of the means in the hot and cold chambers for reciprocating the regenerator sections in phased relation thereto.

23. The invention as set forth in claim 22 above, wherein the regenerator enclosure further comprises a superheated chamber in direct communication with one end of the series of regenerator sections and a supercooled chamber in direct communication with the opposite end of the series of regenerator sections, and the system further includes means coupling intermediate regions of the series of regenerator sections to the hot and cold chambers respectively.

24. The invention as set forth in claim 23 above, wherein the series of regenerator sections further comprise insulating means between each regenerator section and the regenerator enclosure.

25. A thermodynamic machine comprising:

hot and cold work chambers each including cyclically movable means for displacing working fluid therein;

a regenerator coupling the hot and cold work chambers;

drive means coupled to the cyclically movable means for reciprocating them in selected phase relation;

regenerator extension means coupled to the regenerator at each end thereof; and a volumetric means including displacer means communicating with the regenerator extension means for cycling working fluid in selected phase relation to the cyclically movable means, and in opposite senses relative to the different ends of the regenerator.

26. The invention as set forth in claim 25 above, wherein the thermodynamic machine is a Stirling cycle system and the cyclically movable means comprise at least one displacer and power piston.

27. The invention as set forth in claim 25 above, wherein the regenerator comprises a housing and an interior multi-section regenerator reciprocable therein, including regenerator extensions adjacent each end and superheating and supercooling chambers at opposite ends.

28. The invention as set forth in claim 25 above, wherein the regenerator comprises a housing defining a central cavity along an axis, a plurality of regenerator annuli serially disposed along the axis and means defining flow path conduits directing working fluid radially through the regenerator annuli.

29. The invention as set forth in claim 25 above, wherein the thermodynamic machine further includes an intermediate temperature level work chamber.

30. The invention as set forth in claim 29 above, wherein the displacer means comprises a double-ended displacer.

31. The invention as set forth in claim 25 above, wherein the hot and cold work chambers are in separate devices, each including a separate displacer means.

32. A thermodynamic system for providing substantial thermal energy output with thermal energy inputs having a temperature ratio less than about 1.7 and a maximum temperature less than about 300° C., comprising:

a constant volume thermodynamic machine having a hot working chamber, an intermediate level working chamber and a cold working chamber and including regenerator means coupled to each of the chambers and hot and cold displacer means cycling in phased relation in the hot and cold working chambers;

means coupled to the regenerator means for defining regenerator chambers at the hot and cold ends thereof;

displacer means cycling in phase relation with the hot and cold displacer means and coupled to regenerator chambers for displacing hot working fluid in the regenerator chamber at the hot end of the regenerator means and for displacing cold working fluid in the regenerator chamber at the cold end of the regenerator means; and means coupled to the hot, intermediate and cold levels of the thermodynamic machine for providing thermal inputs to at least one of the levels and extracting output energy from at least one other level.

33. The invention as set forth in claim 32 above, wherein thermal energy is rejected at the third level.

34. The invention as set forth in claim 33 above, wherein the thermal input is provided to the intermediate level and thermal output is taken from the hot level, and thermal energy is rejected at the cold level.

35. The invention as set forth in claim 33 above, wherein thermal input is provided to the hot level, thermal energy is rejected at the intermediate level, and refrigeration energy is derived.

36. The invention as set forth in claim 33 above, wherein the system further includes solar energy collector means coupled to provide thermal input to at least one of the hot or intermediate levels.

37. The invention as set forth in claim 32 above, wherein the thermodynamic machine comprises a closed working fluid system, and including in addition conduit means coupling the hot working chamber to the hot end of the regenerator means, the cold working chamber to the cold end of the regenerator, and an intermediate level of the regenerator means to the intermediate working chamber.

38. The invention as set forth in claim 37 above, wherein the cold level temperature is in the range of −20° C. to 50° C., the intermediate level temperature is in the range of 20° C. to 100° C. and the hot level temperature is in the range of 70° C. to 300° C.

39. The invention as set forth in claim 38 above, including means providing external heat load coupled separately to the hot, intermediate and cold levels of the machine.

40. The invention as set forth in claim 33 above, wherein the regenerator means comprise superheating and supercooling regenerator extension sections having in excess of 99% thermal efficiency.

41. The invention as set forth in claim 40 above, wherein the phase relation of the displacer means coupled to the regenerator means, relative to the cycling of the hot and cold displacer means, and the characteristics of the regenerator extension sections are selected to maintain superheating and supercooling temperatures while compensating for regenerator losses.

42. The method of increasing the coefficient of performance of a thermodynamic machine having hot and cold working chambers interconnected by a regenerator and interchanging a working fluid therebetween, while using a relatively low temperature thermal input and comprising the steps of:

superheating working fluid in communication with the hot end of the regenerator;

retaining a superheated temperature level in communication with the hot end of the regenerator;

supercooling working fluid in communication with the cold end of the regenerator; and retaining a supercooled temperature level in communication with the cold end of the regenerator, whereby pressure excursions in the thermodynamic machine are intensified by decreasing the ineffectiveness of the regenerator.

43. The method as set forth in claim 42 above, wherein the volumes of the hot chamber and cold chamber are cyclically changed, and the superheating and supercooling of the working fluid are effected by displacing the working fluid in phased relation to the volumetric changes in the respective chambers.

44. The method as set forth in claim 43 above, wherein the displacements of the working fluid for superheating and supercooling are opposite-going.

45. The method as set forth in claim 44 above, further including the step of maintaining constant volume in the thermodynamic machine while cycling, superheating and supercooling the working fluid.

46. The method of shifting the temperature level of a quantity of thermal energy, with improved coefficient of performance, where the temperature levels are inadequate for conventional thermodynamic processes, comprising the steps of:

providing a constant-volume thermodynamic cycle with hot, cold and intermediate temperature levels;

providing thermal energy input to at least one of the hot and intermediate temperature levels;

increasing the pressure ratio of the cycle by superheating the hot level and supercooling the cold level;

providing thermal energy input from ambient sources to the cycle at the cold level; and extracting thermal energy from the hot or intermediate level which does not receive thermal energy input.

47. The method as set forth in claim 46 above, wherein the available heat levels range from −20° C. to +300° C. and the temperature ratio is less than about 1.7.

48. The method as set forth in claim 47 above, wherein the cold temperature level is in the range from −20° C. to 50° C., the intermediate temperature level is in the range from 40° C. to 90° C., and the hot temperature level is in the range from 150° C. to 300° C.

49. The method as set forth in claim 48 above, including the step of providing thermal energy input at the hot level and extracting thermal energy output at a lower level.

50. The method as set forth in claim 48 above, including the step of providing thermal energy input at the intermediate level and extracting thermal energy output at the hot level.

* * * * *